US005289708A

United States Patent [19]

Sieg et al.

[11] Patent Number: 5,289,708

[45] Date of Patent: Mar. 1, 1994

[54] CUTTING TOOL FOR A LOCK CYLINDER

[75] Inventors: Giselher Sieg, Erftstadt; Peter Wollweber, Wesseling, both of Fed. Rep. of Germany

[73] Assignee: Emhart Inc., Newark, Del.

[21] Appl. No.: 919,327

[22] Filed: Jul. 27, 1992

Related U.S. Application Data

[62] Division of Ser. No. 687,794, Apr. 19, 1991, Pat. No. 5,193,372.

[51] Int. Cl.[5] ..... E05B 9/08

[52] U.S. Cl. ..... 70/370; 70/372; 70/461; 81/15.9; 30/240; 30/226

[58] Field of Search ..... 70/367-372, 70/379 A, 379 R, 380, 461; 81/15.9; 30/205, 240, 244, 245, 226

[56] References Cited

U.S. PATENT DOCUMENTS

| | | | |
|---|---|---|---|
| 13,570 | 9/1855 | Grover | 30/226 |
| 2,494,996 | 1/1950 | Geddes | 30/226 |
| 2,527,735 | 10/1950 | Johnson | 30/226 |
| 2,543,018 | 2/1951 | Hainline | 30/226 X |
| 2,560,318 | 7/1951 | Wenger | 30/226 |
| 3,333,338 | 8/1967 | Burns | 30/226 X |
| 3,370,353 | 2/1968 | Weissman et al. | 30/226 X |
| 4,194,286 | 3/1980 | Kearns | 30/240 X |

*Primary Examiner*—Peter M. Cuomo
*Assistant Examiner*—Suzanne L. Dino
*Attorney, Agent, or Firm*—J. Bruce Hoofnagle

[57] ABSTRACT

The lock cylinder with an external housing accommodates, on its rear face, a closure element acting upon a mortise lock or the like and with an exchangeably inserted core unit the casing of which contains housing pins as tumblers and a cylinder core equipped with a key channel, said cylinder core also receiving core pins as tumblers and being connected merely in a plug-in manner to coupling pins which issue from said closure element and project freely into a socket in said external housing serving for insertion of said core unit, wherein engagement of said coupling pins extends only over a rear region, which is free from key channels, of said cylinder core. A tool is provided for cutting coupling pins on lock cylinders, which is designed as a gripper with two shearing jaws which are located axially in series and rest laterally adjacently to or in a carrying mandrel such that one of said shearing jaws is arranged rigidly on said carrying mandrel resting on one gripper arm and the second of said shearing jaws connected to a second gripper arm is rotatably mounted behind it in said carrying mandrel.

8 Claims, 10 Drawing Sheets

CUTTING TOOL FOR A LOCK CYLINDER

This application is a division of application Ser. No. 07/687,794, filed Apr. 19, 1991, now U.S. Pat. No. 5,193,392.

BACKGROUND OF THE INVENTION

The invention relates to a lock cylinder comprising an external housing which accommodates, on its rear face, a closure element acting upon a mortise lock or the like and an exchangeably inserted core unit, the casing of which contains housing pins as tumblers and a cylinder core equipped with a key channel, the cylinder core also receiving core pins as tumblers and being connected in a plug-in manner to coupling pins which issue from the closure element and project freely into a socket in the external housing, serving for insertion of the core unit.

The sockets produced as blind holes for the coupling pins arranged in pairs extend in the region of the greatest accumulation of material on both sides of the key channel and end just behind the visible side of the cylinder core. If the coupling pins are of equal lengths, this not only involves unnecessarily deep engagement with the cylinder core but also occupies a region which is better suited to the closure and tumbler variations. The security, on both sides of the key channel is thus increased unnecessarily regardless of the increased production costs.

It is an object of the present invention to construct a lock cylinder of this type which is simple to produce and is sturdy in use so that, as far as possible more space also remains transverse to the key channel in the cylinder core while maintaining the advantages of the plug-in connection with the closure element.

BRIEF SUMMARY OF THE INVENTION

The invention provides a lock cylinder with an external housing which accommodates, on its rear face, a closure element acting upon a mortise lock or the like and with an exchangeably inserted core unit the casing of which contains housing pins as tumblers and a cylinder core equipped with a key channel, said cylinder core also receiving core pins as tumblers and being connected merely in a plug-in manner to coupling pins which issue from said closure element and project freely into a socket in said external housing serving for insertion of said core unit, wherein engagement of said coupling pins extends only over a rear region, which is free from key channels, of said cylinder core.

The invention further provides a tool for cutting coupling pins on lock cylinders, which is designed as a gripper with two shearing jaws which are located axially in series and rest laterally adjacently to or in a carrying mandrel such that one of said shearing jaws is arranged rigidly on said carrying mandrel resting on one gripper arm and a second of said shearing jaws connected to a second gripper arm is rotatably mounted behind it in said carrying mandrel.

The invention therefore provides a lock cylinder which is coupled to the closure element but not at the expense of the cylinder core; instead, the areas of the cylinder core on either side of the key channel remain free to provide further variations with respect to closure and tumblers which promote security. Cavities for this purpose can also be selected better with respect to strength; they are not subject to the spatial condition dictated by the parallel spacing of the coupling pins of the closure element. In specific terms, the invention proposes that engagement of the coupling pins extends over only a rear region of the cylinder core which is free from key channels. The rotation achieved by the now coaxial attachment of the coupling means instead of an overlapping allocation to the key channel is also sturdy in use and allows an unobstructed construction. In this connection, it has also been found desirable for the region which is free from key channels to project beyond the casing of the core unit and to be equipped with a transverse slot to achieve engagement. Such a transverse slot is also less sensitive to tolerances than necessarily congruent blind holes for the admission of the parallel spaced coupling pins which can now also be much shorter and nevertheless effect strong rotation.

To make it possible for prior art lock cylinders to be exchanged for those according to the invention, it is necessary to cut the coupling pins to accurate dimensions. The lock filter can thus provide lock cylinders which are better adapted to the requirement of increased security, complicated or additional tumbler means having been employed in these lock cylinders, using the lateral zones of the key channel.

Such a tool for cutting coupling pins on lock cylinders, in particular lock cylinders according to the invention, is characterised in that the tool is designed as a gripper with two shearing jaws which are located axially in series and rest laterally adjacently to a carrying mandrel such that one shearing jaw is arranged rigidly on the carrying mandrel resting on one gripper arm and the second shearing jaw connected to the other gripper arm is rotatably mounted behind it in the carrying mandrel.

The lock filter locates the tool so that the carrying mandrel axially over-runs the coupling pins which project in an overhanging manner into the socket of the external housing and cuts them exactly, leaving a residual length (stump). This is effected by manual rotation without the need for a visible connection. The shearing jaws are equipped with congruent holes arranged in pairs to correspond to the spatially parallel orientation in pairs of the coupling pins. A further means for achieving an axially dimensioned separating cut results from the fact that the carrying mandrel corresponds in cross section substantially to that of the socket for the core unit. This is therefore a configuration which is equal in size to that of the core unit, so that good support on the internal wall side is achieved in addition to the useful depth limitation. The closure element and its rotary bearing position are not loaded. It has been found desirable for centered supply if the mouth of the hole of the external shearing jaw is funnelled. Virtually half of the hole depth and more can be used for funnelling. An advantageous design is also achieved by an identically designed figure-of-eight-shaped profile of the carrying mandrel, the core unit and an adapted contour of the socket for the fitting core unit. An advantageous possibility for reliable removal of the cut portions of the coupling pins from the socket is achieved by lateral ejection portions in the region of the wall bearing the carrying mandrel, the ejection cross sections being allocated receiving chambers of the other shearing jaw and resting congruently with respect to the ejection cross sections only when the gripper is opened or re-opened. Furthermore, it is constructionally advantageous if the carrying mandrel projects transverse to the pivoting plane of the gripper arms, and a shaft, mounted in the carrying mandrel, of the other shearing jaw forms the joint pin of the gripper. An advantageous design is also achieved owing to a plug-in stop, co-operating with the external housing, on the carrying mandrel. The desired positioning of the gripper relative to the external housing, which positioning can be adapted, for example, to an exchangeable location of the plug-in stop, is achieved in this way. On the other hand, however, the cut size can also be varied in that one shearing jaw is exchangeably allocated to the carrying mandrel. Shearing jaws having different axial lengths can therefore be used.

BRIEF DESCRIPTION OF THE DRAWINGS

The subject of the invention is described in more detail hereinafter with reference to an embodiment and example of application illustrated in the drawings.

DETAILED DESCRIPTION

Figure 1:
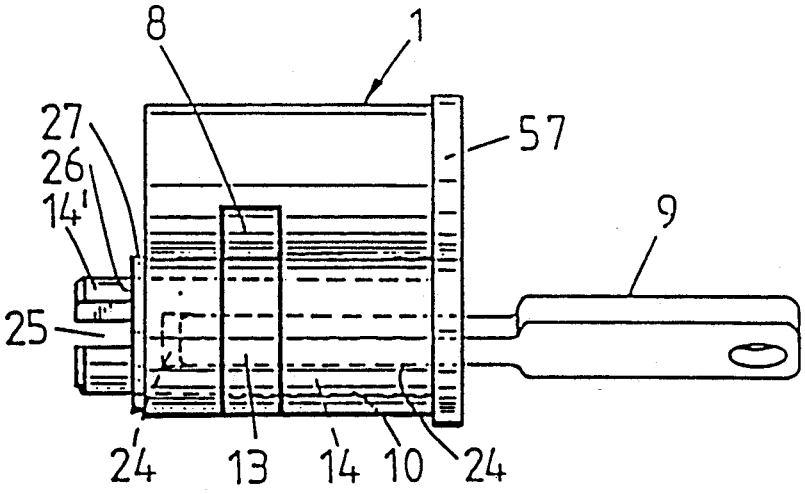
FIG. 1 shows the core unit of the lock cylinder according to the invention in an enlarged side view.
Figure 2:
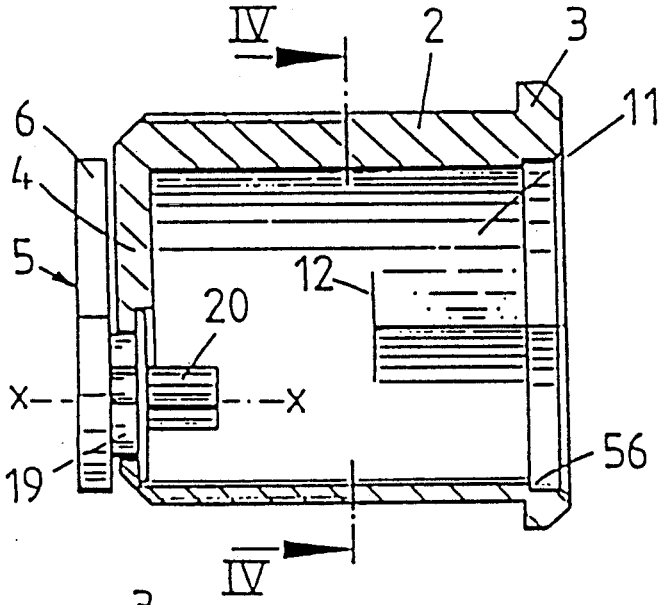
FIG. 2 shows the associated external housing in a vertical section with closure element.

The lock cylinder illustrated consists of a core unit 1. The core unit is received in an external housing 2. The external housing 2 has a pot-shaped configuration and passes at the edges into a supporting flange 3.

A closure element 5 is rotatably mounted in the pot base 4 of the external housing 2. The closing beard 6, extending from the rear face of the external housing 2, of the closure element 5 co-operates with the ward of a mortise lock, not shown in further detail. Its base position can also be turned through 180°, other than illustrated.

To secure the position of the external housing 2, its casing has a thread 7 which co-operates with a corresponding opposed thread of a fastening element.

Figure 3:
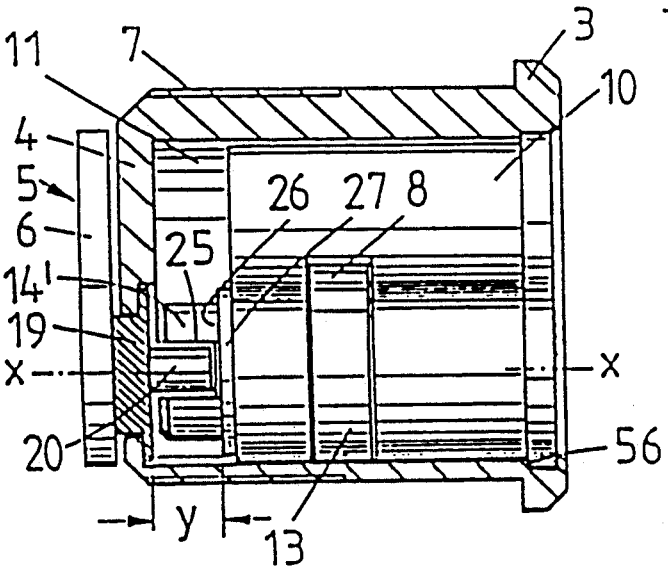
FIG. 3 shows the core unit and the external housing of the lock cylinder combined, the cylinder core being coupled to the closure element.
Figure 4:
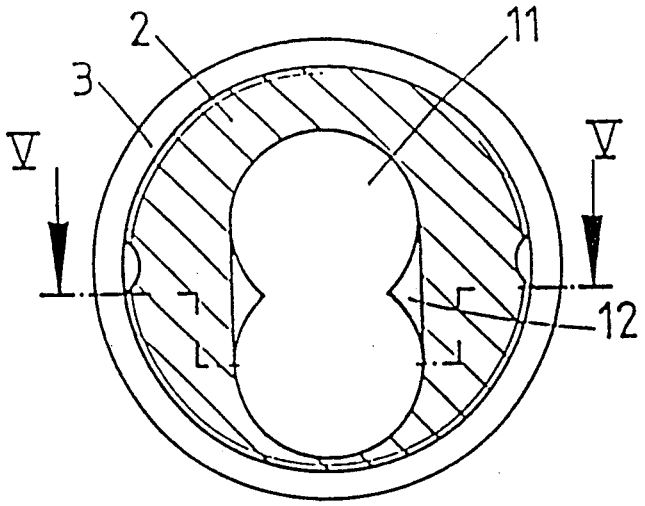
FIG. 4 shows the section along line IV—IV in FIG. 2, illustrating the holding step 12.
Figure 6:
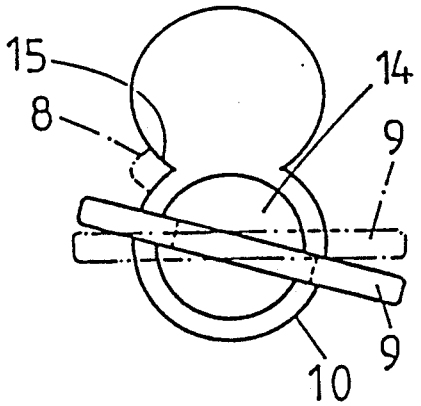
FIG. 6 shows a front view of the core unit.
Figure 7:
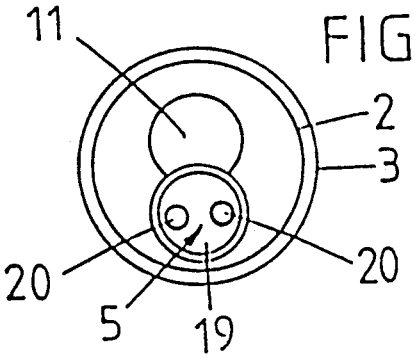
FIG. 7 shows an external housing, with a view inside the socket with coupling pins of a known type penetrating freely therein.

The core unit 1 is exchangeably mounted in the external housing 2. A cog 8 serves to secure the assembly position as shown in FIG. 3. The cog 8 can be retracted by means of a special key 9 for insertion of the core unit 1 behind the cross section of the casting or cylinder housing 10. The cylinder housing 10 has a profile comparable to a figure of eight as shown in FIG. 6. The entry portion of the corresponding socket 11 of the external housing 2 also has the same internal contour. The cog 8 can be turned out beyond the profile silhouette when the final insertion position is reached. It then passes behind a holding step 12 of said external housing 2. This exposed position is secured when the special key 9 is removed.

The cog 8 rests on a ring 13 which can, in turn, be rotated via cylinder core 14 of the core unit 1 until limited by a stop. The cog 8 moves in a gusset zone 15 of the figure-of-eight-shaped profile. The special key 9 can now be removed in the exposed position of the cog 8.

The part of the cylinder housing 10 which is at the top in FIG. 1 receives the so-called housing pins in conventional manner in bores while the core pins rest in similarly direction bores of the cylinder core 14. The housing pins rest in bores and are each loaded by a pin spring. The operation of such ward parts is known.

Figure 8:
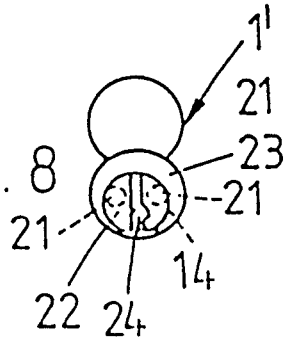
FIG. 8 shows the associated core unit of a known type in a front view illustrating the blind holes receiving the continuous coupling pins.
Figure 9:
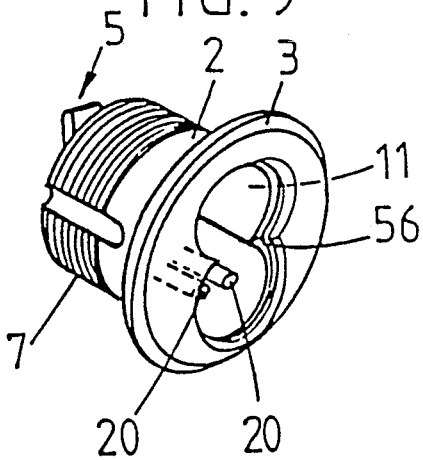
FIG. 9 shows this external housing in a perspective view.
Figure 10:
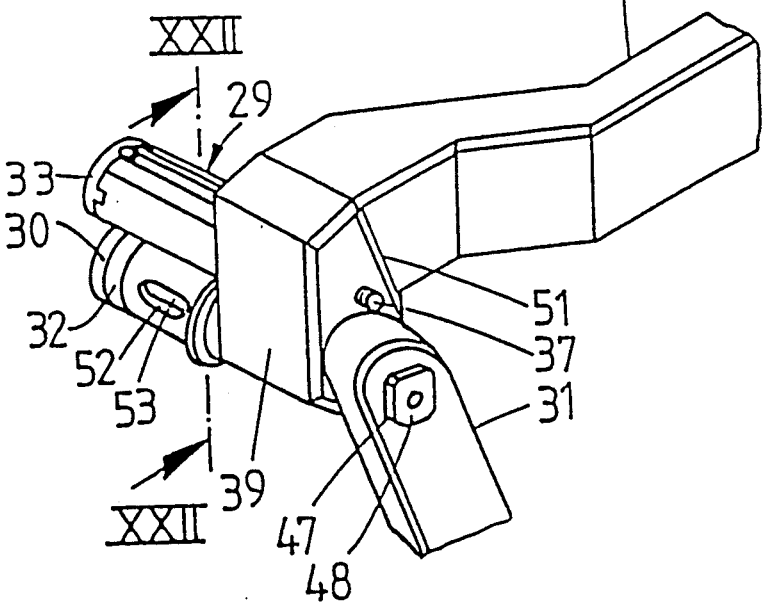
FIG. 10 shows the gripper according to the invention aligned with respect to the socket.

When the core unit 1 is assembled, closure element 5 and cylinder core 14 are rotationally engaged. For this purpose, coupling pins 20 issue from the interior of the bearing portion 19 of the closure element 5. Two such coupling pins 20 are produced. They are located spatially parallel to the horizontal axis of rotation x—x of the closure element 5, which axis of rotation coincides with that of the cylinder core 14. The coupling pins 20 are equally spaced from said axis of rotation. With a conventional core unit 1', as shown in FIG. 8, they engage in congruent blind holes 21 of the associated cylinder core 14. The blind holes extend over almost the entire axial length of the cylinder core 14, i.e. to just behind the front face 23 of the cylinder core 14 having the conventional centering funnel 22. The two coupling pins 20 are of equal length. They consequently occupy the two sites to the side of the key channel 24 which is vertical there. These sites are readily used for constructing further tumblers for achieving even more secure lock variations in current development.

Figure 5:
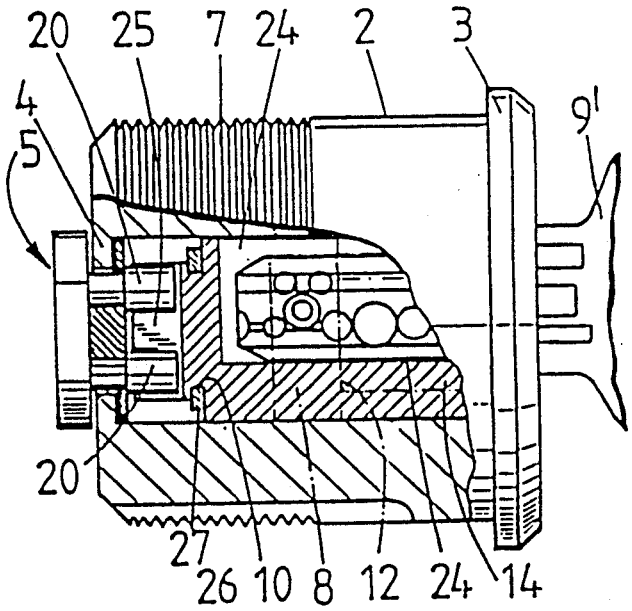
FIG. 5 shows the lock cylinder with the external housing partially broken away to illustrate the cog securing the core unit in the external housing, spatially substantially along the section line V—V in FIG. 4.

On the other hand, there are also core units 1 with a key channel 24 extending perpendicularly, or substantially perpendicularly, to the vertical of the cylinder profile (cf. FIG. 6). Lock cylinders of this type are known from DE-SO 29 47 402. A flat key with a so-called floating ball is used as a further security measure in such cylinders, as shown in FIG. 5.

According to the invention, engagement of the couplings pins 20 therefore extends only over a rear region y, which is free from key channels, of the cylinder core 14. This region y which is free from key channels projects beyond the casing or the cylinder housing 10 of the core unit in the insertion direction thereof, as shown in FIG. 3. The coupling means on the cylinder core side consists of a transverse slot 25 which receives coupling pins 20 and, together with the axial spacing of the two coupling pins 20, ensures rotation. The construction is simple in that the cylinder core 14 continues adjacent to the key channel 24 to just in front of the interior of the pot base 4 of the external housing 2. The free end of the closing beard has the form of a fork piece. Immediately in the outlet region of this end of the cylinder core 14 designated 14' there is located an annular groove 26 for receiving an open resilient holding ring 27 which holds, i.e. axially secures, the cylinder core 14 in the operating state.

If a core unit 1 (FIG. 3) is now to be provided instead of the core unit 1' (FIG. 8), for example during subsequent fitting out, the excessively long coupling pins 20 do not represent a fundamental obstruction; they are severed to a size which still secures engagement. A core unit which meets higher security requirements, for example, can thus be exchanged, for example for a standard unit. The lock fitter will use the tool in the form of a gripper Z also shown in the drawings. After insertion thereof, engagement of the coupling pins 20 extends only over a rear region y, which is free from key channels, of the cylinder core 14.

The gripper Z has two gripper arms of equal length. One gripper arm, designated by 28, passes into a carrying mandrel 29 located transverse to the pivoting plane of the gripper arms. The gripper arm has a stationary shearing jaw 30. The other gripper arm, designated by 31, has a shearing jaw 32 rotatably mounted in the carrying mandrel 29. The two shearing jaws are located axially in series, more specifically adjacent to or in the carrying mandrel 29.

Figure 15:
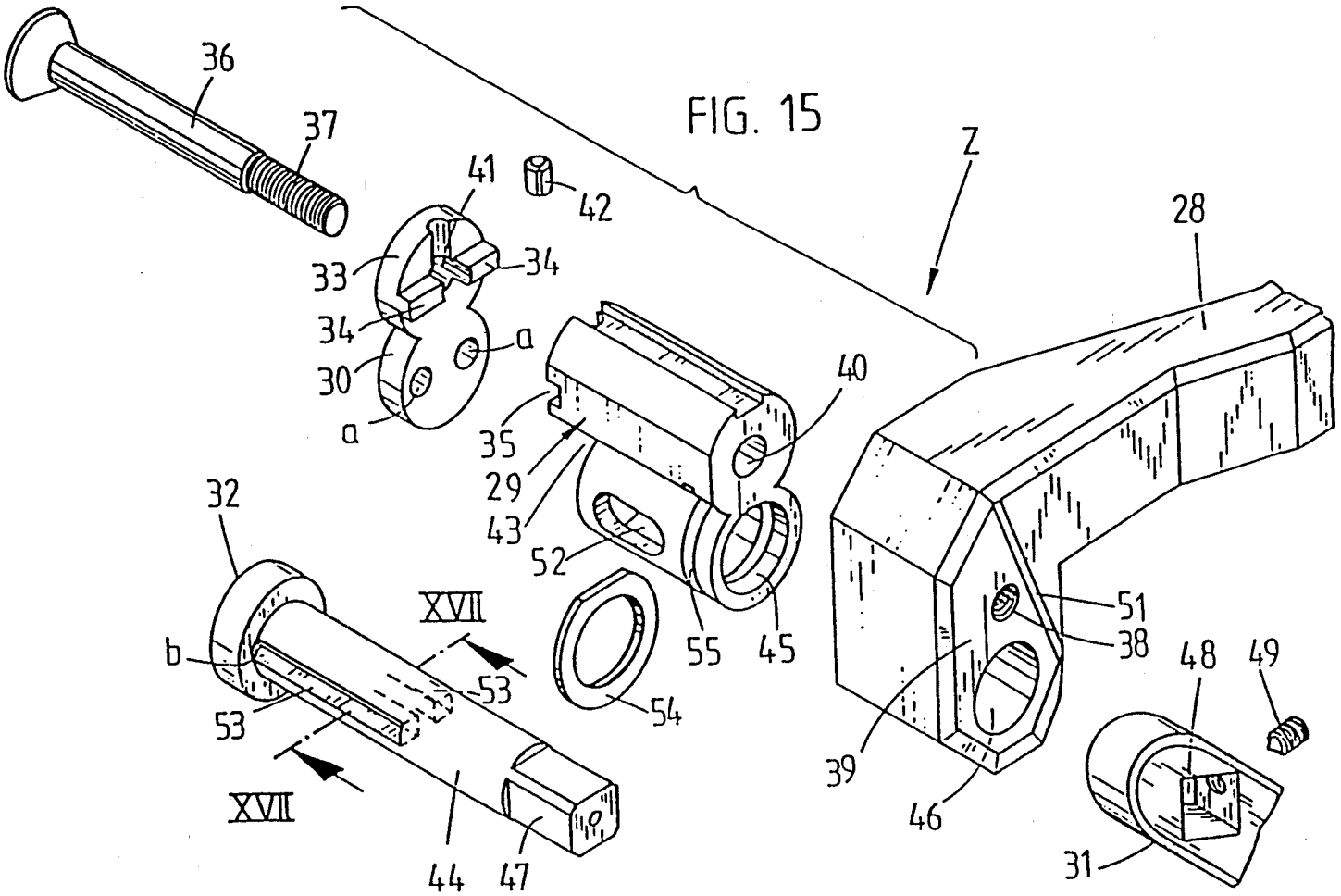
FIG. 15 shows the gripper in an exploded perspective view.
Figure 19:
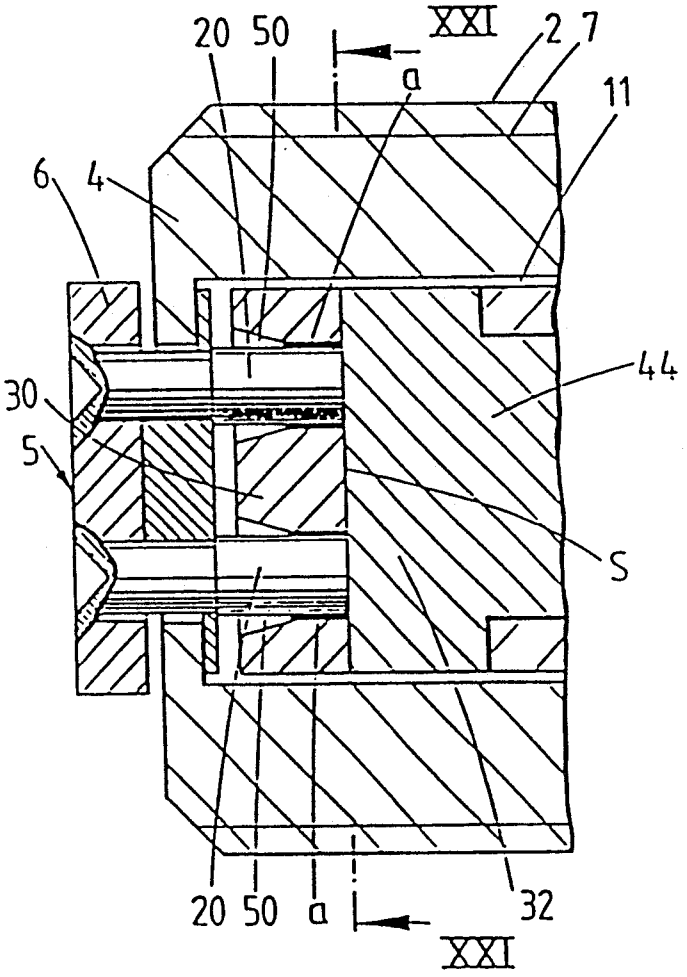
FIG. 19 shows an identically located section after partial shearing of the coupling pins.
Figure 18:
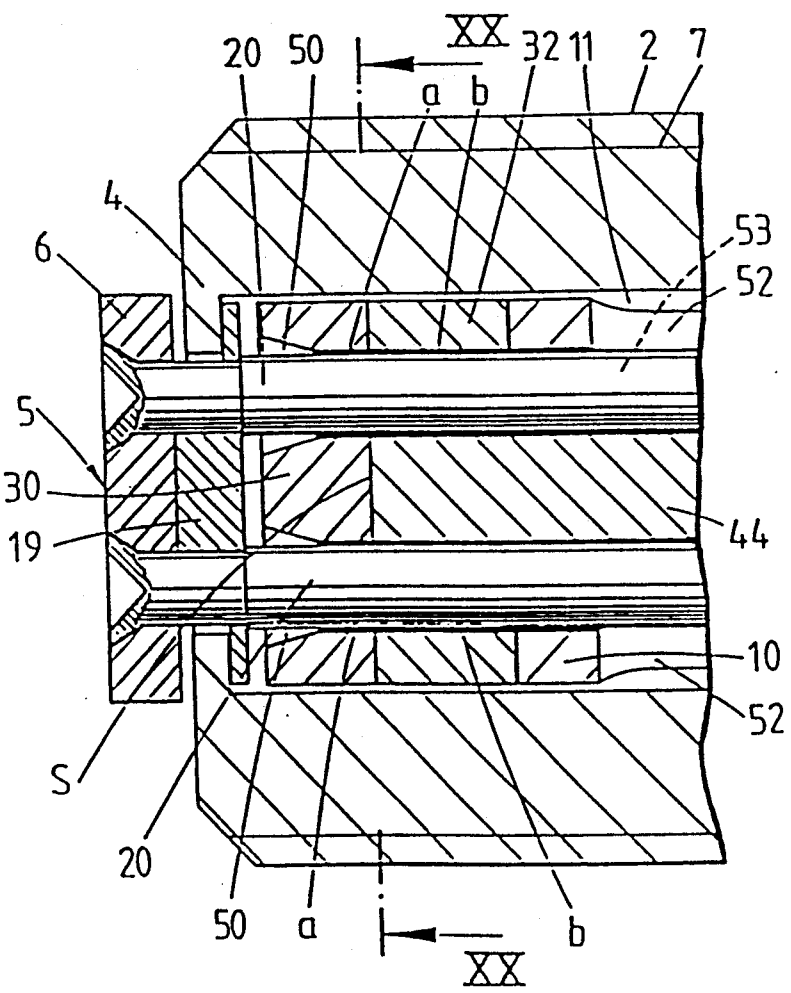
FIG. 18 shows the section along line XVIII—XVIII in FIG. 14, more specifically reproducing the situation prior to shearing on an enlarged scale.
Figure 20:
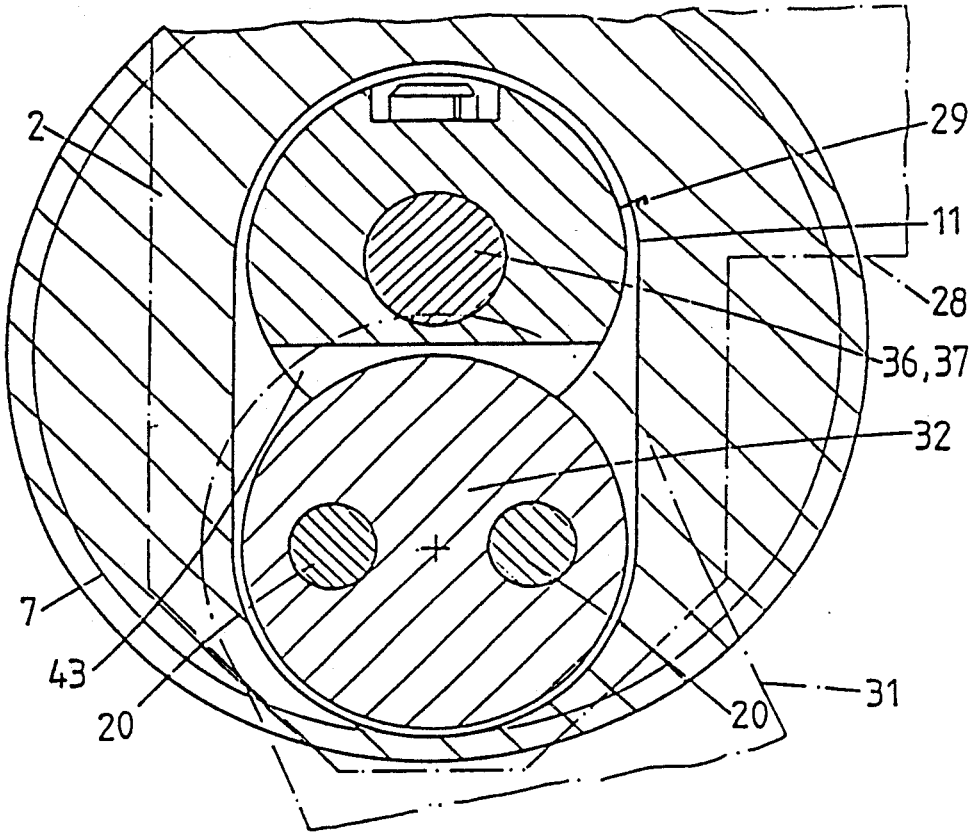
FIG. 20 shows the associated cross section along line XX—XX in FIG. 18.
Figure 21:
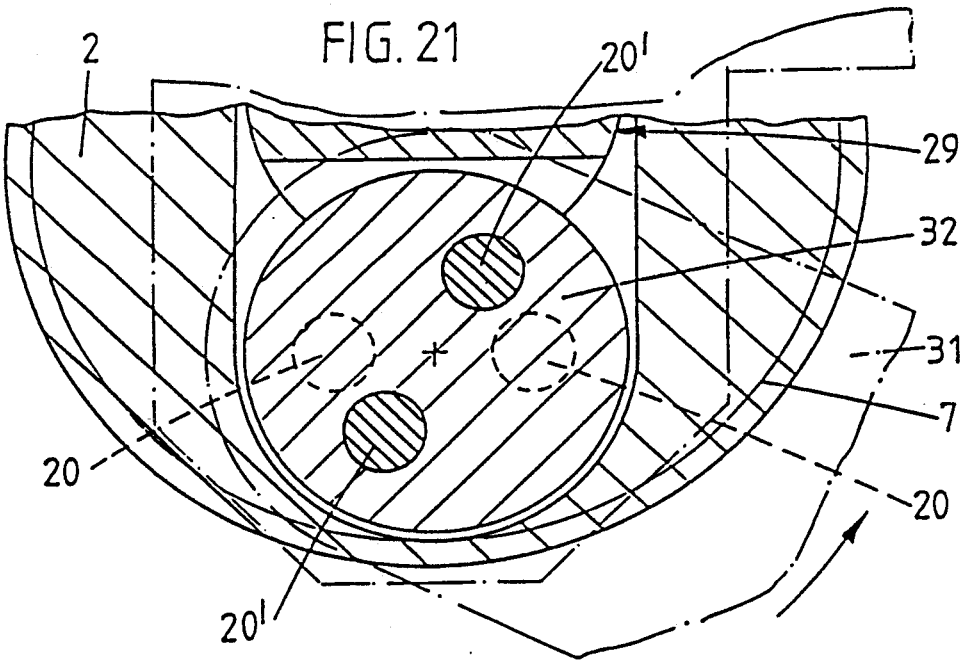
FIG. 21 shows the associated cross section along line XXI—XXI in FIG. 19.
Figure 22:
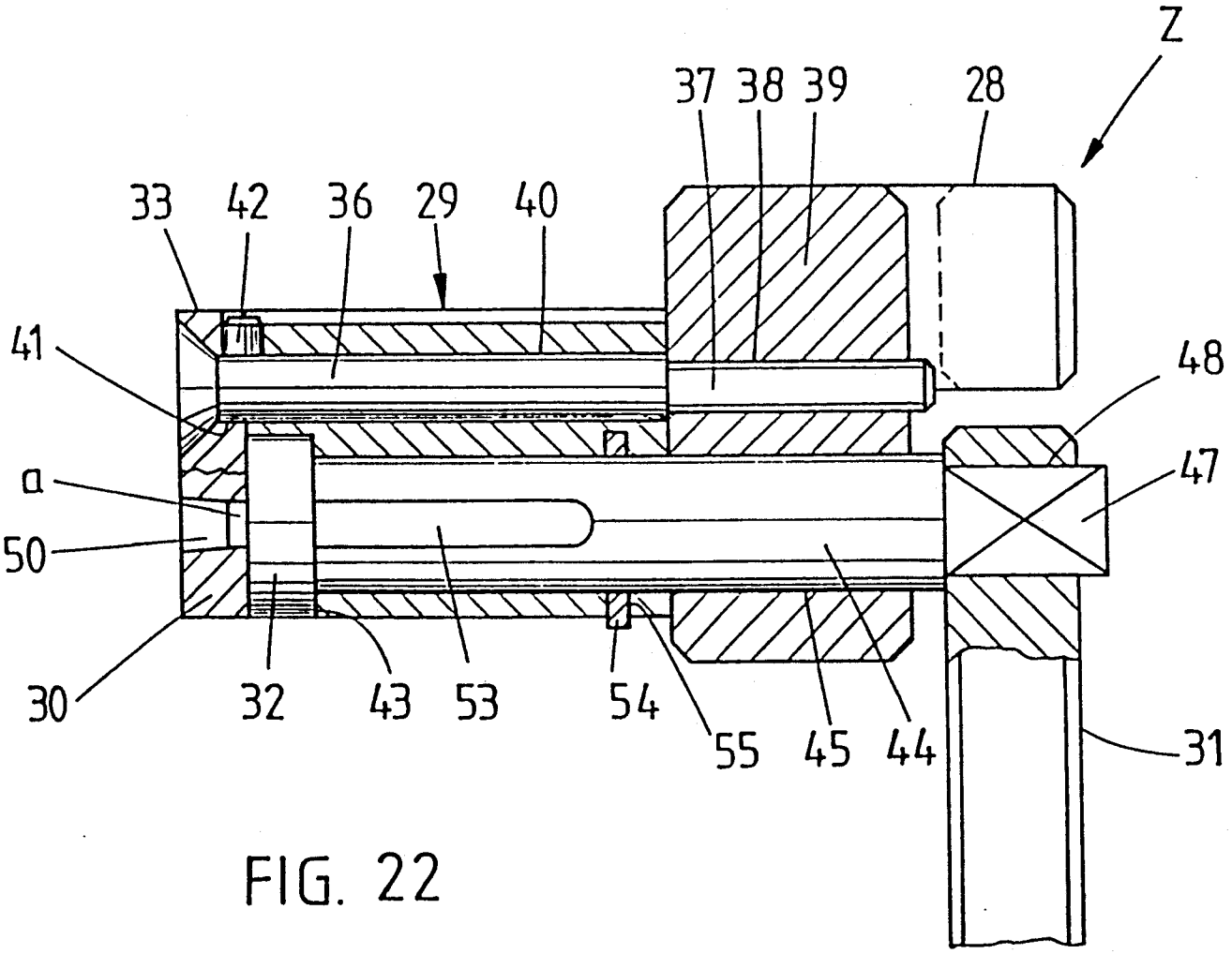
FIG. 22 shows the section along line XXII—XXII in FIG. 10.

Reference will now be made to the exploded view in FIG. 15. One shearing jaw 30 is non-rotatably engaged in front of the free end of the carrying mandrel 29, the dimensions and external design of which are designed, in close compliance with the figure-of-eight-shaped profile of the core unit 1 or 1'. The insertable portion of the carrying mandrel can thus be radially supported on the casing wall side and can be inserted into the socket 11 of the external housing 2.

One shearing jaw 30 issues as a downwardly directed cantilever from a holding plate 33 of corresponding contour. Its rear which faces the free front end of the carrying mandrel 29 carries a diametral transverse rib 34. This transverse rib 34 engages in rotation preventing manner in a corresponding transverse groove 35 of the carrying mandrel 29. For fastening the shearing jaw/-holding plate unit 30/33 a fastening screw 36 is provided which passes longitudinally through these parts, the thread 37 of which engages in an internal thread 38 of a joint jaw 39 of a gripper arm 28. The upper part of the figure-of-eight-shaped profile of the carrying mandrel 29 has the associated longitudinal bore 40 which is aligned coaxially with the internal thread 38. The longitudinal bore on the holding plate side carries reference numeral 41. A splint 42, half of which engages in a suitable vertical bay in the holding plate 33 and in the front end of the carrying mandrel 29, forms an additional rotation preventing means and, if it is of a corresponding length, can also form a rotation preventing means for the screw 36.

The rotatably mounted shearing jaw 32 spatially located behind the sharing jaw 30 rests in a portion which is axially undercut in the lower part of the figure-of-eight-shaped profile of the carrying mandrel 29 and is designated as a niche 43. The width of the niche corresponds to that of the shearing jaw 32 which is also inserted peripherally there with identical alignment.

The gripper arms 28, 31 are superimposed by a right angle bend in the bent region of the joint jaw 39.

The shearing jaw 32 which passes with its free plane end face flatly against the rear, which is also plane, of the shearing jaw 30 is continued rearwardly into a predominantly cylindrical shaft 44 acting as a joint p±n. This shaft 44 passes through a cylinder chamber 45 acting as a bearing bore and formed by the carrying mandrel bearing wall. A coaxially adjoining longitudinal bore 46 on the joint jaw side allows the passage of the free polygonal end of the shaft 44. The polygon is a square 47. The other gripper arm 31 possessing a socket 48 of corresponding cross section is fastened thereon. A grub screw 49 extending into the socket 48 acts as a securing means. The rotatable shearing jaw 32 can be adjusted in terms of shearing to the shearing jaw 30 by means of this movable gripper arm 31.

As already indicated, the two coupling pins 20 are spaced in parallel. Corresponding parallel spacing is consequently also provided for the shearing jaws 30, 32. A cutting jaw structure is also selected according to the cylindrical shape of the coupling pins 20 in that the shearing jaws 30, 32 have congruent holes arranged in pairs. The holes of the stationary shearing jaw 30 are designated by a and those of the rotatable cutting jaw 32 by b. To ensure that the coupling pins 20 to be clipped are reliably captured, the holes a located at the exposed point, i.e. their mouths, are funnelled. The funnels bear reference numeral 50. Their depth corresponds to substantially half of the thickness of the shearing jaw 30 there. There is therefore an adequate fording region up to the cutting plane designated by S between the two shearing jaws 30, 32.

Figure 11:
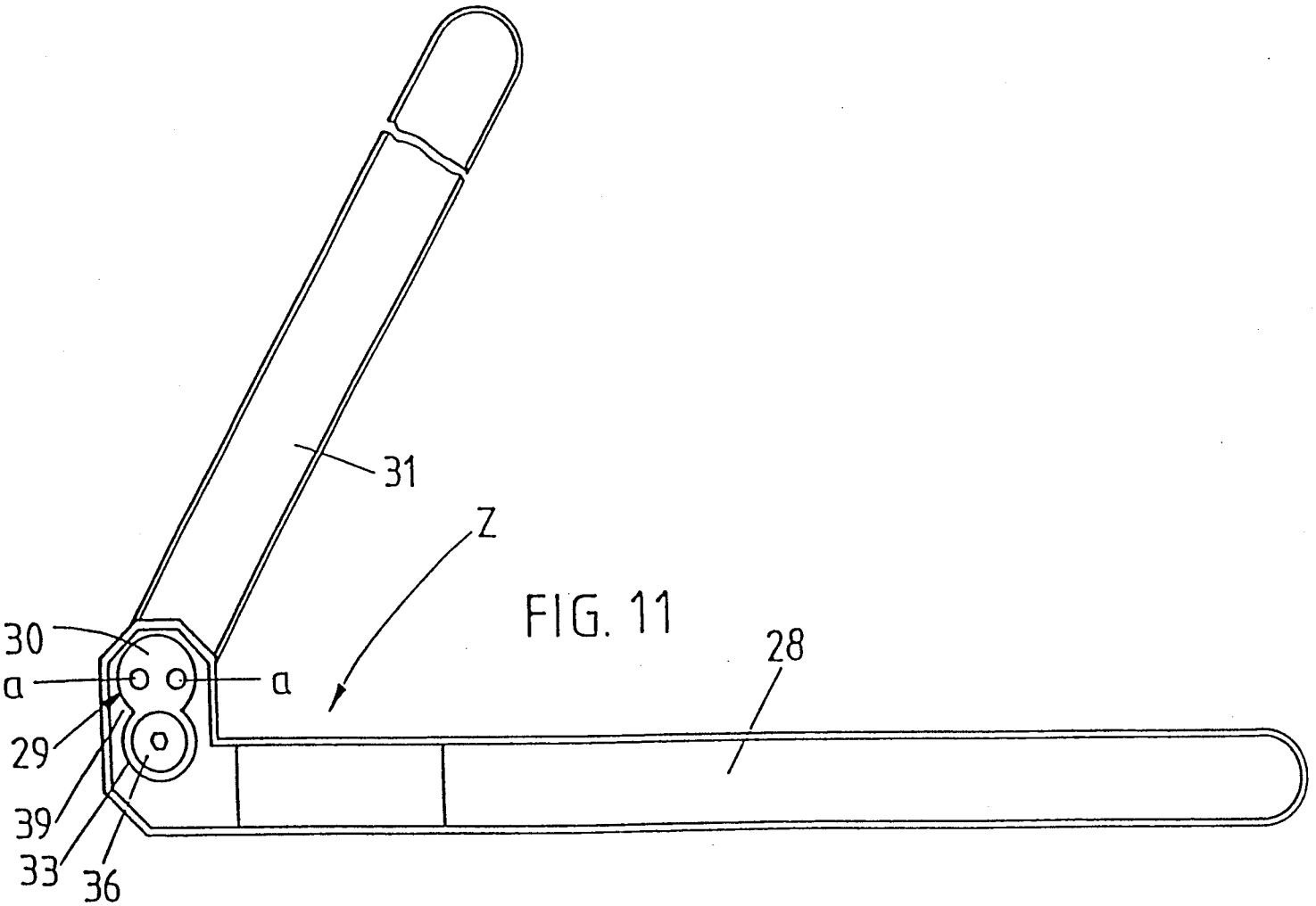
FIG. 11 shows a rear view of the gripper which is ready for allocation.
Figure 12:
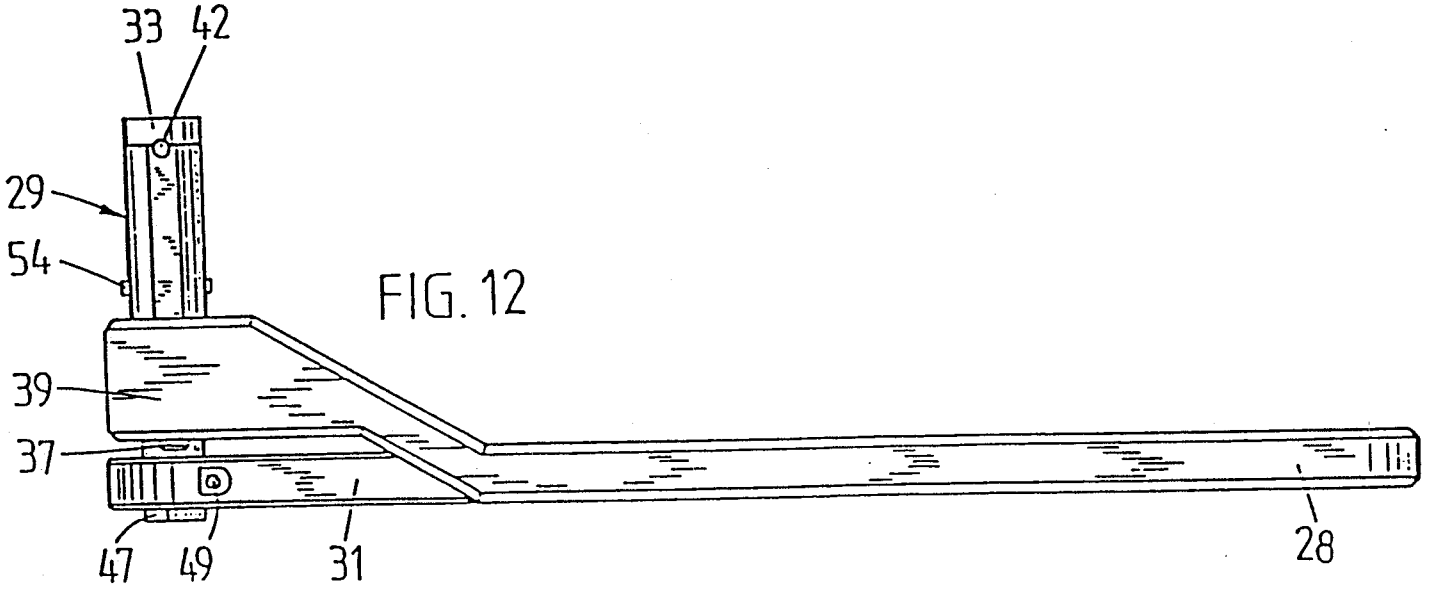
FIG. 12 shows the gripper in a plan view.
Figure 13:
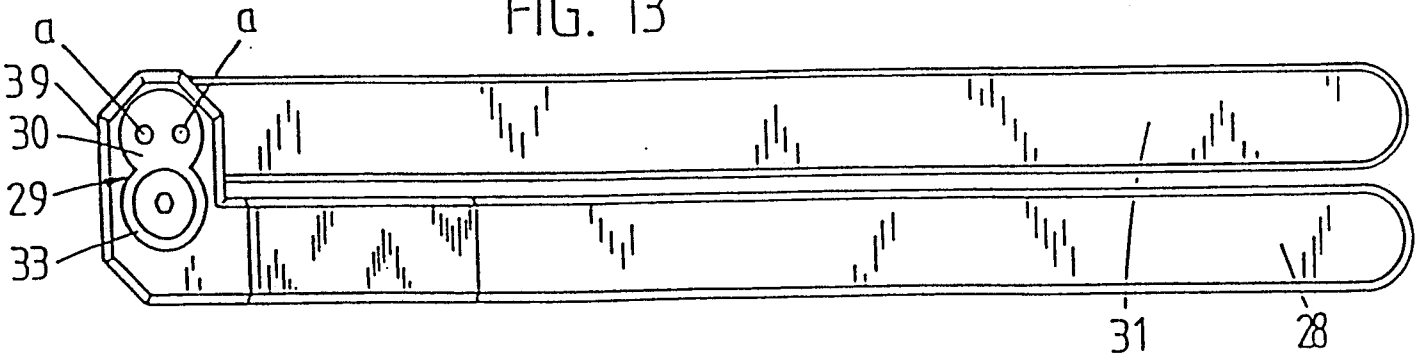
FIG. 13 shows the gripper in a rear view, more specifically after completion of shearing and in the compact base position.
Figure 14:
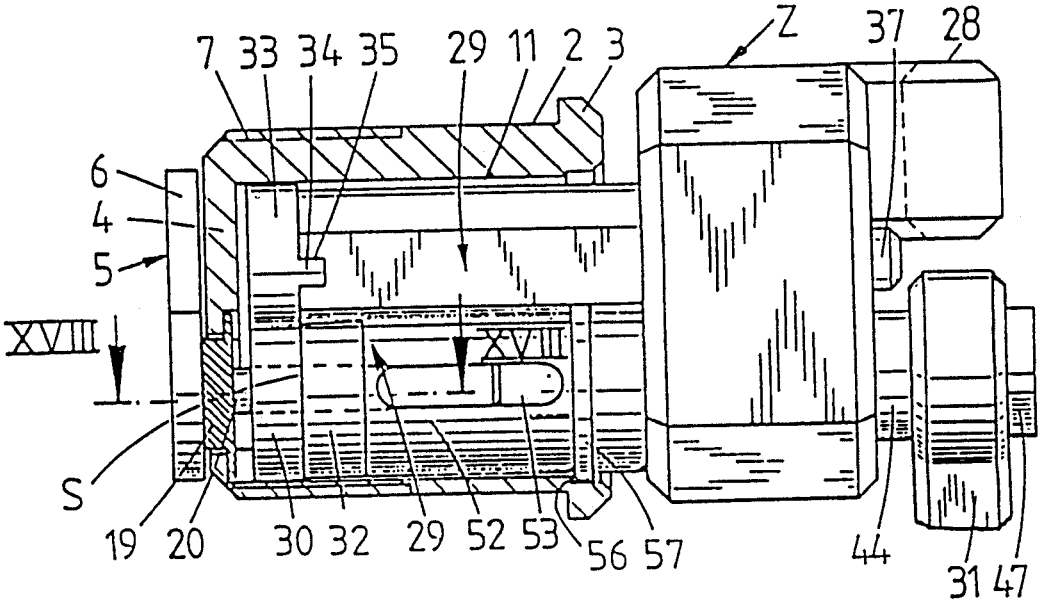
FIG. 14 shows the gripper in the cutting base position when the carrying mandrel is introduced, prior to shearing of the coupling pins.

To bring about the correct gripper arm position for shearing, the gripper Z should be spread, as shown in FIG. 11. An index line 51 can serve as an orientation aid for this purpose. This index line 51 is located on the joint jaw 39 and is aligned, in said position, with the right-hand edge, that is the edge in the interior of the spreading angle, of the other gripper arm 31. In this position, the holes a and b assume a congruent position to one another, aligned with the coupling pins 20 to be clipped.

Figure 16:
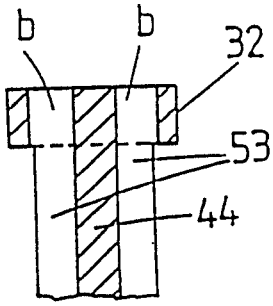
FIG. 16 shows a longitudinal section through the rotatably mounted shearing jaw.
Figure 17:
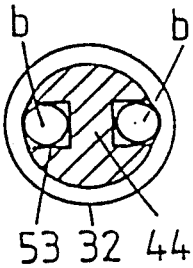
FIG. 17 shows the section along line XVII—XVII in FIG. 15, a cross section through the shaft of the rotatable shearing jaw forming the joint pin of the gripper.

In order reliably to drag the clipped portions 20' of the coupling pins 20 out of the socket 11, a cartridge-like structure is produced. This consists of the construction of lateral window-like ejection cross sections 52. These ejection cross sections 52 are produced in the region of the carrying mandrel bearing wall. They are slot-like apertures, located in the longitudinal direction of the shaft 44, of the corresponding bearing wall of the carrying mandrel 29. Receiving chambers 53 of the shearing jaw 32 or of their shaft 44 respectively radially inwardly precede said ejection cross sections 52. The ejection portions 52 are located, with respect to the axial position of these receiving chambers 53, such that the cut coupling pin portions 20' which are to be removed are bound while still in the tool when the gripper Z is actuated after completion of the separating cut. Only the renewed opening of the gripper Z brings the window-like ejection portions 52 into congruent orientation with the receiving chambers 53 of the rotatable shearing jaw 32 which are also open at the side, while observing the characterised spread position. The portions 20' can then be shaken out easily. As shown by the drawings, in particular FIG. 16, the receiving chambers 53 designed in the form of longitudinal grooves are directly adjacent to the hole b in the rearward direction.

To ensure that the carrying mandrel 29 has an insertion depth which is consistently defined, the carrying mandrel 29 carries a plug-in stop 54 which exceeds the profile of the carrying mandrel 29. This is a ring which can be inserted into a suitable transverse duct 55 of the lower part of the carrying mandrel 29. The internal diameter of the ring corresponds to the diameter of the shaft 44 so that the ring is kept centered thereby. The projecting portion of the plug-in stop 54 co-operates with an internal shoulder 56 of the external housing 2. An end collar 57 of the core unit 1 or 1' normally passes against this internal shoulder 56.

Adjustment of the insertion depth, in particular precise adjustment, can be controlled by means of the thickness of the projecting portion of the annular limiting stop 54.

As an alternative, one shearing jaw 30 together with its holding plate 33 is exchangeably allocated to the carrying mandrel 29. Elements of modified thickness can therefore easily by used here.

In the assembled state, the core unit 1 is actuated in known manner by the associated flat key 9' which has no effect on the relocation of the cog 8.

In operation, therefore, when the core unit 1' (FIG. 8) is to be replaced by another core unit 1, the gripper Z is inserted such that the coupling pins 20 which are excessively long with regard to the standard design, enter the shearing mechanism. By actuating the gripper Z in the shearing sense, the clipper coupling pin portions 20' enter the pocket-like receiving chambers 53. The carrying mandrel 29 is withdrawn. The gripper arms 28, 31 which have moved towards one another so that they virtually touch after the separating cut are spread again into the position which is shown in FIG. 11 and can also be limited by a stop. In this position, the ejection cross sections 52 extend congruently to the receiving chambers 53. The coupling pin portions 20' can now fall out.

Any beards intentionally formed by the shearing process at the heads of the free ends of the stump-like coupling pins prevent re-insertion of the cylinder unit 1'. The cross sections are enlarged relative to the blind holes 21. On the other hand, the transverse slot 25 of the cylinder unit 1 tolerates this dimensional deviation.

We claim:

1. Tool for cutting a coupling pin within a lock cylinder having a hollow enclosure and an opening of a prescribed shape at a first end of the enclosure and at least one coupling pin extending into the enclosure from an inner wall thereof at a second end of the enclosure opposite and spaced from the first end thereof, the tool designed as a gripper with two shearing jaws which are located axially in series and rest laterally adjacently to a carrying mandrel such that a first of said shearing jaws is arranged rigidly on said carrying mandrel resting on a first gripper arm and a second of said shearing jaws connected to a second gripper arm is rotatably mounted adjacent said first shearing jaw in said carrying mandrel, the carrying mandrel being shaped externally to pass through the opening and into the enclosure toward the inner wall to facilitate positioning of the shearing jaws about the coupling pin for cutting thereof.

2. Tool, according to claim 1, wherein said shearing jaws have congruent holes arranged in pairs.

3. Tool, according to claim 2, wherein said carrying mandrel corresponds in cross section substantially to that of a socket for a lock core unit.

4. Tool, according to claim 2, wherein the holes of said first shearing jaw have a mouth which is funnelled.

5. Tool, according to claim 3, wherein the holes of said first shearing jaw have a mouth which is funnelled.

6. Tool, according to claim 1, wherein said carrying mandrel, said core unit and said socket have an identical figure-of-eight-shaped profile.

7. Tool, according to claim 1, wherein lateral ejection cross sections are provided in the region of the wall bearing said carrying mandrel for removing said cut coupling pin portions, said second sharing jaw being formed with receiving chambers being allocated to said ejection cross sections and lying congruently to said ejection cross sections only after said gripper has been opened or re-opened.

8. Tool, according to claim 1, wherein said carrying mandrel projects transversely to the pivoting plane of said gripper arms and a shaft mounted in said carrying mandrel of said second shearing jaw forms a joint pin for the gripper.

* * * * *

UNITED STATES PATENT AND TRADEMARK OFFICE

CERTIFICATE OF CORRECTION

PATENT NO. : 5,289,708

DATED : Mar. 1, 1994

INVENTOR(S) : Giselher Sieg

It is certified that error appears in the above-indentified patent and that said Letters Patent is hereby corrected as shown below:

On the title page, item [73], Assignee insert:
DOM-Sicherheitstechnik GmbH & Co KG Signed and Sealed this Second Day of April, 1996

Bruce Lehman

*Attest:*

BRUCE LEHMAN

*Attesting Officer*

*Commissioner of Patents and Trademarks*